US007943536B2

(12) United States Patent
D'Ottaviano et al.

(10) Patent No.: US 7,943,536 B2
(45) Date of Patent: May 17, 2011

(54) STRETCH FABRICS WITH IMPROVED HEAT-SETTING PROPERTIES

(75) Inventors: Fabio D'Ottaviano, Tarragona Cambrils (ES); Alberto Lora Lamia, Trivero (IT)

(73) Assignee: Dow Global Technologies LLC, Midland, MI (US)

( * ) Notice: Subject to any disclaimer, the term of this patent is extended or adjusted under 35 U.S.C. 154(b) by 314 days.

(21) Appl. No.: 11/659,681

(22) PCT Filed: Aug. 12, 2005

(86) PCT No.: PCT/US2005/028872

§ 371 (c)(1), (2), (4) Date: Feb. 7, 2007

(87) PCT Pub. No.: WO2006/020940

PCT Pub. Date: Feb. 23, 2006

(65) Prior Publication Data

US 2007/0251276 A1 Nov. 1, 2007

(51) Int. Cl.

| | |
|---|---|
| ***D06C 7/02*** | (2006.01) |
| ***D06M 101/16*** | (2006.01) |
| ***D04B 1/18*** | (2006.01) |
| ***D04B 21/18*** | (2006.01) |

(52) U.S. Cl. ..... 442/306; 66/170; 66/171; 28/143; 28/165; 8/115.51

(58) Field of Classification Search ..... None
See application file for complete search history.

(56) References Cited

U.S. PATENT DOCUMENTS

| | | | | |
|---|---|---|---|---|
| 5,198,288 | A | 3/1993 | Grunfeld | |
| 6,437,014 | B1 | 8/2002 | Ho et al. | |
| 2002/0064653 | A1 * | 5/2002 | Ladika et al. | 428/364 |
| 2003/0060529 | A1 | 3/2003 | Ho et al. | |
| 2004/0068802 | A1 * | 4/2004 | Miller et al. | 8/115.51 |

FOREIGN PATENT DOCUMENTS

| | | | |
|---|---|---|---|
| AU | 2003281591 | A1 * | 2/2004 |
| EP | 0629247 | | 12/1994 |
| EP | 1541729 | | 6/2005 |
| JP | 2003328253 | A * | 11/2003 |
| JP | 2004-211254 | | 7/2004 |
| WO | WO-93/17162 | | 9/1993 |
| WO | WO-99/63021 | | 12/1999 |
| WO | WO-03/078705 | A1 | 9/2003 |
| WO | WO-2004/009888 | | 1/2004 |

OTHER PUBLICATIONS

"Radicispandex Corporation Technical Information Bulletin Type S-5 Polyester Spandex Fiber Technology"; http://www.radicispandex.com/s5Tech.html, accessed Jul. 16, 2004.

* cited by examiner

*Primary Examiner* — Jennifer A Chriss

(57) ABSTRACT

The present disclosure is directed to dimensionally stable stretch or elastic textile articles characterized in that the article has not been subjected to temperatures greater than 160° C. The disclosure is also directed to a method to make dimensionally stable stretch articles characterized by the absence of a traditional heat-setting step.

18 Claims, No Drawings

STRETCH FABRICS WITH IMPROVED HEAT-SETTING PROPERTIES

The present invention relates to stretch fabrics having improved heat-setting properties. In one aspect, the invention relates to stretch fabrics comprising synthetic fibers where the synthetic fibers comprise crosslinked, heat-resistant elastic fibers, and where such fabric does not need heat setting, or alternatively where such fabric can be heat-set at a temperature less than about 160° C.

Fabrics made at least in part from fibers made from elastic synthetic materials are well known in the art. It is also known that these fabrics may shrink or otherwise become distorted during wet processing of the fabric or as a result of consumer use and care.

Heat-setting is a common way of reducing or eliminating the dimensional instability. The heat-setting process typically involves passing the fabric through a heating zone for a time and at a temperature that resets the synthetic fiber's morphology memory to the dimensions of the fabric at the time when the heat-setting process was applied. The time and temperature needed for the heat treatment depend on factors such as the fabric construction, the weight of the fabric, the type of synthetic fiber, other fibers present in the fabric, and the previous heat history of the synthetic fiber. The issue of dimensional instability is especially pronounced for stretch fabrics, particularly knitted stretch fabrics.

For stretch fabrics, such as those incorporating spandex, typical heat-setting conditions are from 180° C. to 210° C. for 15 to 90 seconds. These relatively harsh conditions may negatively effect the tenacity of companion fibers and lead to fabric color alteration. Furthermore, the heat-setting step is typically an additional step which adds expense to the fabric production process. For example, in a circular knitting process the fabric is produced in a tube form, which may have to be cut first to allow for width adjustment in tentering.

Accordingly it would be desirable to have a fabric containing elastic fibers which did not require a special heat-setting step, or alternatively which could be heat set at a temperature of less than 160° C., such that the heat-setting could be accomplished simultaneously with other steps in the fabric production process.

Fibers and fabrics made from polypropylene are well known in the art, but tend to melt at the temperatures at which spandex is normally heat-set. Thus, with current elastic fabrics it is not possible to use polypropylene or any other thermoplastic material having a melting point less than about 180° C. It would also be desirable to be able to use such fibers in dimensionally stable stretch fabrics.

The present disclosure is accordingly directed to fabrics which incorporate stretch or elastic fibers, which fabrics retain their dimensional stability without the need for traditional heat setting steps. The present disclosure is also directed to a method of producing knitted stretch fabrics having good dimensional stability wherein the method is characterized by the absence of any step in the production process which is performed at a temperature of 160° C. or more. The stretch fabrics include elastic fibers, preferably polyolefin based fibers and may also include natural fibers including cellulosic, more preferably cotton and wool based fibers; and/or other synthetic fibers, including polyolefin such as polyethylene and/or polypropylene, polyester, polyamide, and segmented polyurethane fibers. The finished stretch fabrics preferably have a dimensional stability of higher than −5 percent, more preferably higher then −3 percent, but no more than 5 percent, preferably no more than 3 percent most preferably within ±1.5 percent. Dimensional stability values indicated in this invention refer to the difference between the finished fabric length and widthwise dimensions after vs. before laundering plus tumble drying as defined by AATCC135-1987; preferably by drying method: A—tumble drying. It is also anticipated that some fabrics may contain fibers which are not recommended for normal laundering (that is, aqueous) processes. In such cases the dimensional stability values will refer to the difference between the finished fabric length and widthwise dimensions after vs. before dry cleaning according to the recommended care practices for the companion fiber(s) in the fabric. Negative values indicate that the final washed dimensions are shorter than the initial ones which translates to shrinkage.

Knitted fabrics, and particularly elastic knitted fabrics, are known to suffer from a lack of dimensional stability over home laundering, for example, excessive stretching or shrinkage. Traditional methods for producing knitted fabrics therefore include a heat setting step, particularly when the fabric includes fibers incorporating synthetic polymers. The heat-setting step is done after knitting and can be done either prior or post dyeing. The heat setting process generally involves applying a biasing force to hold the fabric at its desired dimensions (typically with the use of tenter frames) and subjecting it to high temperatures, particularly temperatures higher than any temperature that the fiber or article is likely to experience in subsequent processing (for example, dyeing) or use (for example, washing, drying and/or ironing). Although not intending to be bound by theory, it is believed that the heat-setting process generally works as follows: The heat-setting temperatures are such that at least some of the crystallites in the fiber will melt. The fabric is then removed from the heat, and the molten portions are allowed to recrystallize, and then the biasing force can be removed. The recrystallization causes the fabric to have a "memory" of the dimensions at which the fabric was maintained during the heat-setting process, even after the biasing force is removed.

It has been discovered that by selecting certain synthetic elastic fibers for use in the knitted fabrics, the heat setting step can be omitted, while still producing a fabric having acceptable dimensional stability. One aspect of the present invention is therefore directed to a method for making a knitted fabric characterized in that the entire process occurs at a temperature less than about 160° C. Depending on the content of other fibers which make up the fabric, even lower temperatures can be used without sacrificing dimensional stability. Thus, the entire process may occur at a temperature of less than 150° C., 140° C., 125° C., 100° C. or even 80° C.

In certain embodiments of this invention, the process can further be characterized by an absence of tentering. Thus, yarns or fibers containing at least some elastic material can be knitted into fabric and the fabric can directly be subjected to the desired finishing treatments without the need for placing the fabric into a tenter frame and exposing it to the high temperatures normally associated with heat-setting.

It is preferred that the finishing treatments include at least one step in which the temperature is higher than 80° C. In this way, the fabric will be "fixed" in a similar manner to the typical heat setting process, but at a lower temperature and without the need for special apparatus to ensure a biasing force. Typical finishing steps are conducted at temperatures of 80° C. or greater, which is sufficient for this purpose.

The present invention is also directed to textile articles having stretch and dimensional stability, where such fabrics have not been subjected to a heat-setting treatment at 160° C. or greater. For purposes of the present invention, "textile articles" includes finished fabric as well as products made from the fabric including bedsheets and other linens, and garments. For purposes of this invention a material is characterized as "stretch" (or as elastic) if it contains elastic fiber. For purposes of the present invention an elastic fiber is one that will recover at least about 50 percent, more preferably at least about 60 percent even more preferably 70 percent of its stretched length after the first pull and after the fourth to 100 percent strain (double the length). One suitable way to do this test is based on the one found in the International Bureau for Standardization of Manmade Fibers, BISFA 1998, chapter 7, option A. Under such a test, the fiber is placed between grips set 4 inches apart, the grips are then pulled apart at a rate of about 20 inches per minute to a distance of eight inches and then allowed to immediately recover.

It is preferred that the elastic textile articles of the present invention have a high percent elastic recovery (that is, a low percent permanent set) after application of a biasing force. Ideally, elastic materials are characterized by a combination of three important properties, that is, (i) a low stress or load at strain; (ii) a low percent stress or load relaxation, and (iii) a low percent permanent set. In other words, there should be (i) a low stress or load requirement to stretch the material, (ii) zero or low relaxing of the stress or unloading once the material is stretched, and (iii) complete or high recovery to original dimensions after the stretching, biasing or straining is discontinued.

It is preferred that the articles of the present invention, particularly the plain single jersey knit fabrics of the present invention, recover promptly to dimensions which are less than 20 percent over its original dimension after being stretched up to (1) 100 percent widthwise and/or (2) 45 percent lengthwise (all at extension rate of 500 mm/min for a specimen 50 mm wide and gauge length 100 mm). More preferably, the article will return to within 15 percent of the original dimensions, and more preferably to within 10 percent. It should be understood that the amount of stretch and recovery will be a function of the weight of the fabric and the fabric construction. It is also contemplated that the articles of the present invention will have stretch in more that one direction, and indeed for many applications this will be preferred. It is not necessary that the articles have the same amount of stretch in each direction to be within the scope of this invention.

The textile articles of the present invention are dimensionally stable. For purposes of this invention "dimensionally stable" means that the stretch fabrics change less than 5 percent in either direction (growth or shrinking), more preferably less than 3 percent in either direction, and even more preferably less than 2 percent in either direction and most preferably within ±1.5 percent. Shrinkage is generally perceived as being the typical form of dimensional instability and the fabrics of the present invention will have a dimensional stability higher (that is, less negative) than −5 percent in the width and/or the lengthwise direction. preferably higher than −4 percent, more preferably higher than −3 percent and most preferably higher than −2 percent (with 0 percent representing no shrinkage or growth). Dimensional stability values are calculated by the difference between the finished fabric's length and/or widthwise dimensions after vs. before laundering. To determine dimensional stability, the length and width of the finished article are measured, then the article is subjected to laundering (such as the method described in AATCC135-1987 drying method: A—tumble drying). If the fabric contains fibers such as wool, for which laundering is not recommended, then alternatively, the article may be subjected to a dry cleaning process as suggested for care of the particular non-elastic fibers used in the fabric. After laundering or dry cleaning, the length and width are measured again, and the percentage is calculated according to the formula: dimensional stability=(new dimension−original dimension)/original dimension. As will be readily understood by one in the art, the negative values indicate that the final washed dimensions are shorter than the initial ones which translates to shrinkage.

The textile articles of the present invention are known as stretch or elastic articles, which for the purposes of this invention, means that they contain an elastic fiber. Elastic fibers include certain fibers made from polyolefins such as polyethylene or polypropylene and segmented polyurethane (polyester or polyether based). It is preferred that the elastic fiber be a synthetic fiber. The preferred elastic fiber for use in the present invention is a cross linked polyolefin fiber, more preferably a cross linked polyethylene fiber, of which cross linked homogeneously branched ethylene polymers are particularly preferred. This material is described in U.S. Pat. No. 6,437,014, (which is hereby incorporated by reference in its entirety) and is generically known as lastol. Such fibers are available from The Dow Chemical Company under the trade name Dow XLA fibers. It is also contemplated that more than one type of elastic fiber may be used in the articles of the present invention. It is preferred that the elastic fibers not include fiber made from segmented polyurethane, however, as this material promotes dimensional instability in the absence of heat setting at temperatures greater than 160° C. It is preferred that the elastic fibers comprise from 2 to 20 percent by weight of the article.

The elastic fibers for use in the present invention can be of any cross-sectional shape or thickness, although 20-140 denier is most preferred, particularly when the fiber is the preferred cross linked homogeneously branched ethylene polymers.

The elastic fiber may be used bare, or it may first be incorporated into a multifilament, for example, covered yarn, or into staple fibers for example, corespun yarn, as is generally known in the art. Furthermore, elastic fiber may be a monofilament or a conjugate fiber, for example a sheath/core bicomponent fiber.

The textile articles of the present invention may further comprise one or more non-elastic synthetic fibers. Non-elastic synthetic fibers include those made from materials such as polyester, nylon, polyethylene, polypropylene, and blends thereof.

In addition to the synthetic fiber(s), the textile articles of the present invention may include one or more natural fibers, including fibers made from one or more cellulosic materials such as cotton, flax, ramie, rayon, viscose and hemp. For many applications, the cellulosic materials will comprise 60 to 98 percent by weight of the textile article, and for some applications preferably greater than about 85 percent. Natural fibers from other materials can also be used in the textile articles of the present invention, including fibers such as wool, silk or mohair.

The avoidance of the high temperatures typically used during a heat setting step facilitates the use of fibers such as polypropylene which had not been used with previous stretch fabrics. Thus, another aspect of this invention is a dimensionally stable elastic textile article comprising fibers made from polypropylene.

It should be understood that depending on the fibers present in the fabric, some heat setting may be beneficial, even if no such heat setting is required as a result of using the preferred elastic fibers of the present invention. For example, if polyester is present, temperatures around 160° C. may advantageously be used to provide dimensional stability to the polyester content only. Even fabrics containing only cotton are often exposed to temperatures as high as 140° C. in order to dry after wet finishing treatments. Thus, it may be desirable to have a finishing step as high as 140° C. for the cotton-containing fabrics of the present invention.

The articles of the present invention may be knitted by any means known in the art. This includes circular, flat and warp knitting, and garment knitting technologies such as seamless articles.

The type of knitting construction is also not intended to be a limiting factor of the present invention. Known construction types include plain single jersey, single jerseys containing tuck and miss stitches (such as Lapique, Cross-mis 1×1, Lacoste & Plain pique), double jerseys (such as Plain Rib and Plain Interlock), double jerseys containing tuck and miss stitches (such as Milano Rib, Cardigan, Single Pique & Punto di Roma). Of these, the plain single jersey construction is known to be the most dimensionally unstable and so may benefit the most from the present invention.

After forming the greige fabric any finishing processes known in the art may be used. This includes processes such as scouring, mercerizing, dyeing and drying. It is preferred that at least one of the finishing processes be conducted at a temperature which is greater than any to which the end consumer will likely expose the garment, for example 80° C. or greater.

EXAMPLES

To demonstrate the invention, a set of plain single jersey knits were produced in a 24 needles/inch machine with 30 inches diameter. As the base yarn, a texturized polyester ('PES') 100 den/144 filaments yarn was used, while either 40 denier lastol or 40 denier spandex were employed as the elastic filament by plating technique. The fabrics were prepared as follows:

Forty denier lastol was subjected to 3 different levels of draft. The draft in this case is the relationship between the feeding speeds of the PES yarn and the feeding speed of the lastol as measured by the speed of the positive feeder. Two methods were employed for changing the draft: (1) altering only the stitch length (also known as altering the feeding speed) of the PES yarn, rendering two different settings for Example 1 and Example 2 (2) simply altering the elastic positive feeder speed on Example 2 which makes Example 3.

Example 4 is a comparison using 40 den spandex which was subjected to a widely used machine setting in which the tension in the draft zone (that is, the zone between the stop-motion and the machine elastic feeder) reached 4.5 cN. This resulted in a draft of 3.35 times with stitch length equal to 3.1 mm.

After knitting, the greige fabrics were subjected to one hour-laundering consisting of a 30 min heating cycle followed by 30 min at 90° C. with washing powder; followed by tumble drying and then conditioned to 20° C.+/−2° C. and relative humidity of 65 percent+/−2 percent. The aim of this test was to realize the density in grams per square meter and width in cm of all fabrics in their most relaxed form—which is also known as a "boil-off test".

The table below demonstrates the results achieved,

| 20 C. at 65% RH lab conditioning | | | | | | |
|---|---|---|---|---|---|---|
| | | | Width (cm) | | | |
| | Stitch | | | After | Density (g/sqm) | |
| | Lgth. | Draft | Greige | wash | Greige | After wash |
| Example 1 | 3.1 mm | 3.35 | 86 | 62.5 | 98 | 224 |
| Example 2 | 3.3 mm | 3.6 | 87 | 60.5 | 91.5 | 230 |
| Example 3 | 3.3 mm | 4 | 84 | 63.5 | 93 | 230 |
| Example 4 (comp.) | 3.1 mm | 3.35 | 70 | 50 | 140 | 380 |

Heat = 2.33 C./min
1 hr washing cycle

As can be seen from this data, the fabrics with lastol are wider and lighter (less dense) both in the greige state and after the boil-off (that is, the lastol containing fabrics are more dimensionally stable).

The same greige fabrics used in Examples 1-3 (that is, the fabrics prior to boil off) were also subjected to a standard finishing process for polyester fabrics comprised of:

Scouring, (with 90° C. being the highest temp in use);

Dyeing with disperse dyestuff (with 130° C. being the highest temp in use);

Spinning to reduce wet content by centrifugal force;

Cutting the fabric to open width for subsequent tentering; and

One-step tenter drying and heatsetting in order to heat set the PES content of the fabric, (the temperature of the chambers used in this process was set at 160° C. and a residence time of 60 seconds was used).

During tentering, the machine settings were positioned in a way to achieve 160 g/sqm as finished fabric density for all 3 cases. This shows that these 3 fabrics were finished in a different (that is, stretched) dimension if compared to those of their most relaxed form (that is, boil-off dimension: example 1=224 g/sqm; example 2=230 g/sqm; example 3=230 g/sqm).

A dimensional stability test over the three finished fabrics (former examples 1, 2, and 3) was taken with the following conditions: 1 hr washing cycle at 49° C. followed by hot air tumble drying. The stability lengthwise as well as widthwise was as follows:

| | Example | | |
|---|---|---|---|
| | #3 | #2 | #1 |
| Length | −1% | −1% | −1% |
| Width | 0% | −2% | 0% |

These numbers confirm that the stretch fabrics of the present invention do not need a conventional heatsetting of their elastic content to render width and lengthwise dimensional stability values better than the value traditionally required by industry (5 percent) for low shrinkage (that is, highly dimensional stable) elastic knits.

We claim:

1. A dimensionally stable knit article comprising elastic cross-linked polyolefin fibers, characterized in that such article has been subjected to a finishing treatment having at least one step conducted at a temperature higher than 80° C.

but has not been subjected to a processing step having a temperature greater than 160° C.

2. The article of claim 1 wherein the absolute value of the dimensional stability is less than 3 percent.

3. The article of claim 1 wherein the elastic fibers comprise one or more cross linked polyolefin polymers.

4. The article of claim 1 wherein the elastic fibers comprise a cross linked homogeneously branched ethylene polymer.

5. The article of claim 1 wherein the article has not been subjected to temperatures greater than 140° C.

6. The article of claim 1 wherein the article is made from a single knit fabric.

7. A method of producing a dimensionally stable stretch knit article comprising fiber made from a cross linked polyolefin elastic material, said method comprising a finishing treatment having at least one step conducted at a temperature higher than 80° C. further characterized in that the temperature during article finishing does not exceed 160° C.

8. The method of claim 7 further characterized in that the process does not include the use of a tenter frame.

9. The method of claim 7 further characterized in that the article finishing includes a heat setting step.

10. The method of claim 7 comprising the step of selecting one or more cross linked polyolefin polymers as the elastic material.

11. The article of claim 1 wherein the article additionally comprises cellulosic fibers.

12. The article of claim 11 wherein the cellulosic fibers include cotton fibers.

13. The article of claim 4 wherein the fiber made from crosslinked homogeneously branched ethylene polymer comprises 2 percent to 10 percent by weight of the article.

14. The article of claim 1 wherein the article comprises fiber made from polypropylene.

15. The article of claim 1 wherein the article is in the form of a garment.

16. The article of claim 1 wherein the article is in the form of a linen.

17. The article of claim 1 wherein the article is in the form of finished fabric.

18. The article of claim 14 wherein the elastic fiber comprises a cross linked homogeneously branched ethylene polymer.

* * * * *